United States Patent [19]

Slattery

[11] 4,397,249

[45] Aug. 9, 1983

[54] TUFTING MACHINE HOOK FOR FORMING LOW PILE FABRIC

[75] Inventor: Ian Slattery, Hixson, Tenn.

[73] Assignee: Spencer Wright Industries, Inc., Chattanooga, Tenn.

[21] Appl. No.: 364,433

[22] Filed: Apr. 1, 1982

[51] Int. Cl.[3] ..... D05C 15/00

[52] U.S. Cl. ..... 112/79 R

[58] Field of Search ..... 66/79 R, 79 A

[56] References Cited

U.S. PATENT DOCUMENTS

| | | | |
|---|---|---|---|
| 2,090,021 | 8/1937 | Baynton et al. | 112/79 R |
| 3,361,096 | 1/1968 | Watkins | 112/79 R |
| 4,193,359 | 3/1980 | Beasley . | |
| 4,303,025 | 12/1981 | Bardsley | 112/79 R |

*Primary Examiner*—Ronald Feldbaum
*Attorney, Agent, or Firm*—Alan Ruderman

[57] ABSTRACT

A cut pile tufting machine having needle plate backing support fingers oscillated in timed relationship with the hooks and the needles to support the backing material during needle penetration and to withdraw from the needle path as the hooks move across the needle path to seize loops has the bill of the hooks reduced in thickness on a portion thereof. The bill has a lower or cutting edge and an upper edge, and the portion of reduced thickness is provided by narrowing the upper edge relative to the lower edge along that portion of the bill on which a loop seized by the hook is drawn against and cut.

7 Claims, 3 Drawing Figures

TUFTING MACHINE HOOK FOR FORMING LOW PILE FABRIC

BACKGROUND OF THE INVENTION

This invention relates to tufting machines and more particularly to hooks for tufting machines for producing cut pile fabric having very low pile heights.

In Bardsley U.S. Pat. No. 4,303,025, assigned to the assignee of the present invention, apparatus is disclosed for moving the needle plate fingers of a tufting machine away from the needle path after the needles have penetrated the backing material as the hooks move toward the needle path. This allows a path of movement for the hooks which lies closely adjacent to the opposing face of the backing material. Thus, the limitations imposed by the needle plate finger geometry, i.e. the thickness of the needle plate fingers, on the pile height produced is removed so that low level cut pile may be formed. Accordingly, the distance of the cutting edge or underside of the bill of the hook from the backing material, and hence the dimensions of the tuft to be formed, can be determined by reference only to the geometry of the bill and the disposition and movement of the hook. When the needle plate fingers have moved away from the needle path, which is after the fingers have fulfilled their intended function of supporting the backing material during penetration, the backing material is supported on the upper surface of the hooks. Thus, the dimension of the tuft formed is determined by the geometry of the bill and the disposition and movement of the hook.

Such apparatus has been extremely successful and pile heights as low as 0.075 inch have been obtained, such low cut pile being unobtainable prior to the introduction of the apparatus of the aforesaid patent. The availability of producing such low level cut pile on tufting machines has virtually created a totally new market for tufting, that being the manufacture of cut pile upholstery fabrics. Such fabrics have heretofore been produced exclusively by weaving looms and knitting machines, but since the tufting process is faster and utilizes less yarn, its advantages are readily apparent. Since the greatest cost involved in the manufacture of tufted fabrics is the cost of the yarn, it is highly desirable to reduce the amount of yarn placed into the backing material, such reduction being attained by reducing the pile height. Consequently, it is apparent that a reduction in the pile height below that attained by the prior art apparatus is a significant achievement.

Since such low level pile is produced on very fine gauge machines, i.e. where the spacing between gauge parts is in the order of 1/16 to 1/20 inch, the thickness of the hooks is such that the hooks have relatively little strength. Narrowing the bill would merely reduce the strength even further.

SUMMARY OF THE INVENTION

Consequently, it is a primary object of the present invention to provide a hook for a tufting machine for reducing the height of the face pile produced by such machines.

It is another object of the invention to provide a hook for a tufting machine having a geometrical configuration that allows the production of lower level cut pile fabrics than heretofore attainable.

It is a further object of the present invention to provide a cut pile hook for tufting machines, the hook having a bill that includes a portion of reduced dimension between the barb and the throat for reducing the pile height of a loop of yarn thereon without substantially reducing the strength of the hook.

It is a still further object of the present invention to provide a cut pile hook for a tufting machine, the hook having a barb at the free end for seizing loops of yarn, and a bill extending from the barb toward a throat, the bill having a lower edge for cooperating with a knife, and an upper edge, the upper edge having a portion reduced in dimension in the direction relatively to the lower edge.

It is a still yet further object of the present invention to provide in a tufting machine for producing very low cut pile fabric, a fine gauge hook, the hook having a barb at the free end for seizing loops of yarn, and a bill extending from the barb toward a throat, the bill having a lower edge for cooperating with a knife, and an upper edge, the upper edge having a portion reduced in dimension in the direction relative to the lower edge.

Accordingly, the present accomplishes these objectives by providing a hook having a shank at one end for mounting the hook, a bill extending from a throat of the shank and terminating at a barb, the bill having a reduced thickness on a portion thereof extending from the barb to substantially intermediate the barb and the throat. The bill has a lower or cutting edge and an upper edge, and the portion of reduced thickness is provided by narrowing the upper edge relative to the lower edge. The reduced portion comprises that portion of the bill on which a loop seized by the hook is drawn against and cut when the hook is operatively positioned in a tufting machine. Preferably, a number of such hooks are fixedly mounted in a hook module so as to provide accurate and easy assembly in a tufting machine, and to provide greater rigidity to the hook assembly.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
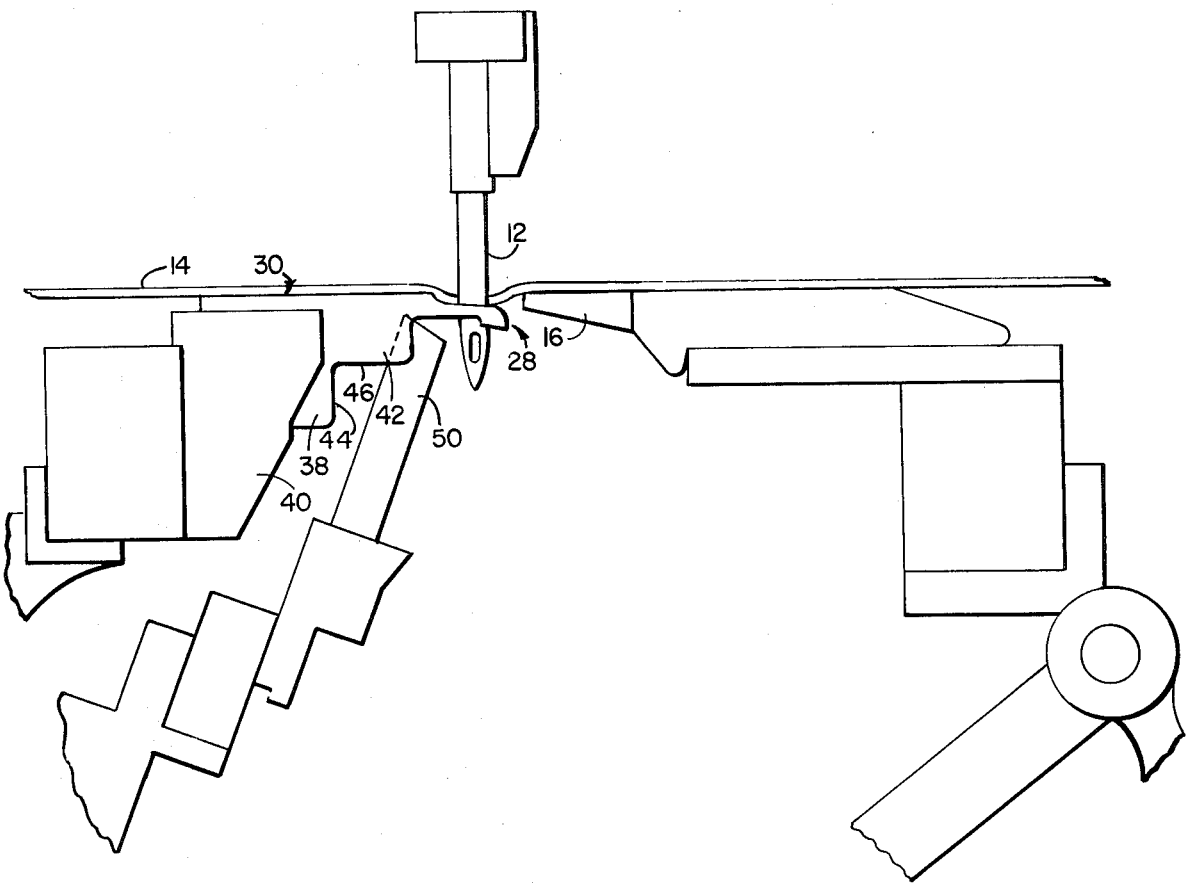
FIG. 1 is a diagrammatic side elevational view of the tuft-forming instrumentalities of a tufting machine incorporating hooks constructed in accordance with the present invention.
Figure 2:
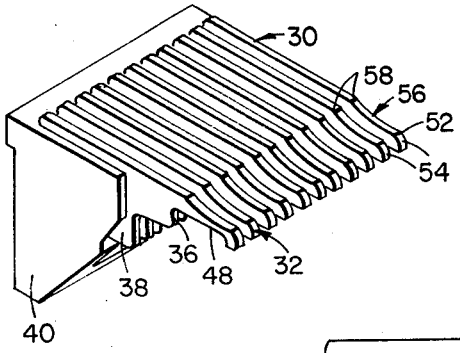
FIG. 2 is a perspective view of a hook module incorporating hooks depicted in FIG. 1.

Referring now to the drawings a portion of a tufting machine is illustrated incorporating apparatus as disclosed in the aforesaid Bardsley patent and hooks constructed in accordance with the principles of the present invention. In the aforesaid patent, after the needles 12 have penetrated the backing material 14 and continued to descend, the support or needle-plate fingers 16 are moved away from the path of reciprocation of the needles in timed relationship with the oscillation of the hooks 28, the hooks moving toward the needle path into loop seizing engagement with the needles. As the hooks oscillate away from the needlepath after loop seizure, the fingers 16 move toward the needle path to provide support for the backing material 14 when the needles next penetrate the backing material. For a full description of these principles and the apparatus for carrying them into effect reference may be made to the aforesaid patent, the disclosure of which is incorporated herein by reference. The present description illustrates only that portion thereof believed necessary to an understanding of the invention claimed herein.

Utilizing hooks of conventional design, mechanism of the aforesaid patent is capable of producing fabric having a pile height of approximately 0.075 inch or approximately 5/64 inch. Since the largest factor in the cost of producing such fabric is that of the yarn, large cost savings can be effected by a reduction in the pile height to approximately 0.050 inch or approximately 3/64 inch. Hooks 28 constructed in accordance with the principles of the present invention provide such capability.

Figure 3:
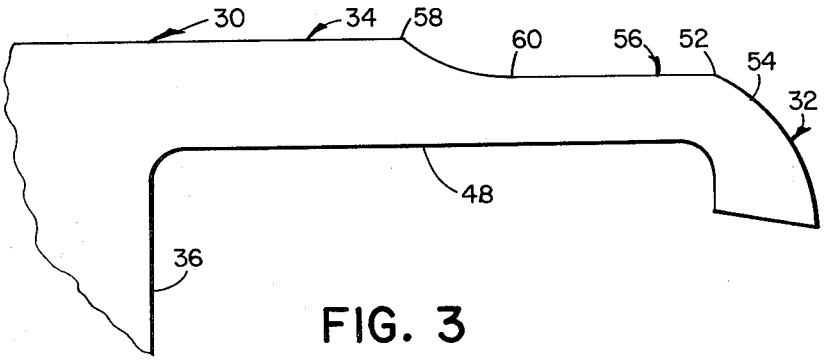
FIG. 3 is a side elevational view of a fragment of the hooks in a greatly enlarged scale.

As illustrated in FIG. 3, the hooks 28 comprise a shank 30 at one end, a barb or beak 32 at the other end and a blade or bill 34 extending from a throat 36 of the shank and terminating in the barb. As illustrated, the free end of the shank 30 includes an enlarged mounting portion 38 and the mounting portions of a number of hooks preferably are cast integrally into a common body member 40 such as that disclosed in U.S. Pat. No. 4,303,024. Thus, the shank has a stepped section, the step being formed by undercutting the shank along an edge 44 to form an edge 46 spaced from the bottom edge of the remainder of the shank. However, the present invention contemplates conventionally mounted hooks whereby the edge 46 of the section 42 may extend rearwardly without being enlarged or a neck may be formed parallel to the throat with the mounting portion extending from the bottom of the throat so that the shank may be mounted in conventional hook bars.

The underside of the bill 34 extending from the throat 36, has a sharpened bottom edge 48 which conventionally acts as a ledger blade in cooperation with an oscillating knife blade 50 in the tufting machine. Conventionally, the upper edge of the barb 32 flows smoothly to join the upper edge of the bill which extends rearwardly to the shank without any discontinuities. In the present invention, however, at the termination point 52 of the upper edge 54 of the barb 32, the upper edge of the bill is dimensionally reduced or narrowed relative to the bottom edge 48 for a portion of the length of the bill. This dimensionally reduced portion 56 of the bill is preferably formed by grinding the upper surface of the bill and extends to a point 58 which is slightly beyond the location where loops seized by the hook are cut, i.e. slightly behind the cutting point 60 where the knife 50 will cut each seized loop. Thus, since it is proposed to use a grinding wheel to reduce the dimension of the bill, the reduced portion 56 is a radial arc. Because of the radius, point 58 is elevated relative to the point 60, but since the loops are cut at point 60, only the thickness of the bill at that location determines the pile height. As a general rule, the location of the point 60 is approximately one-quarter inch from the throat 36. On a fine guage hook, i.e. hooks spaced from adjacent hooks by approximately 1/16 to 1/20 inch the length of the bill from the rear of the barb to the throat is in the order of approximately $\frac{3}{8}$ to $\frac{1}{2}$ inch so that the reduced portion extends to a location substantially intermediate the rear of the barb and the throat.

During operation of a tufting machine incorporating structure as disclosed in Bardsley U.S. Pat. No. 4,303,025 and a hook as described above, the seized loops move rearwardly along the bill by the movement of the backing material toward the closed end of the hook, and as each loop is tightened against the bottom edge 48 the spacing between the backing material 14 and the bottom edge 48 is determined substantially by the thickness of the bill. At the point 60 the loops are cut in succession. The pile height of the tuft is thus determined by the thickness of the bill at the point 60 rather than that of point 58 and the remainder of the bill. A lower pile height is consequently attained vis a vis the prior art hooks. Moreover, by merely reducing the thickness of the bill in a small portion thereof, the strength of the hook is not substantially reduced, if reduced at all. Normally hooks fail along the throat or at the barb, but since the dimensions at these locations are not changed, there is little or no change in the overall hook strength, especially if the hooks are mounted in modular body parts which dampen the vibrational characteristics.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having set forth the nature of the invention what is claimed herein is:

1. A cut pile hook for use in a tufting machine, said hook being planar and comprising a body member having a bill and a shank having a mounting portion, said bill extending from the shank to define a throat therebetween, a barb extending from said bill remote from said shank, said bill having a top edge and a bottom edge that extends from said throat to said barb, said barb having a top edge that slopes toward the top edge of said bill and a bottom edge spaced below the bottom edge of said bill to define a joining edge connecting the bottom edge of said barb and the bottom edge of said bill, the improvement wherein said top edge of said bill is dimensionally reduced relative to said bottom edge for a portion of the extent of the top edge of said bill, said reduced portion extending from adjacent the top edge of the barb to at least substantially intermediate said joining edge and said throat.

2. A cut pile hook as recited in claim 1, wherein said reduced portion extends from the top edge of the barb to approximately one-quarter inch from said throat.

3. A cut pile hook as recited in claim 1, wherein said bottom edge of said bill is sharpened for cooperating with a knife oscillating into cutting engagement at a point on said bottom edge, and said reduced portion extends from the top edge of the barb to a location disposed substantially above said point.

4. A cut pile hook as recited in claim 1, wherein a respective mounting portion of a plurality of hooks are integrally mounted in a module.

5. In a tufting machine, means for supporting a moving backing material, a plurality of yarn carrying needles supported on one side of said backing material, means for reciprocating said needles for penetrating the backing material and forming loops therein, a hook corresponding to each needle disposed on the opposite side of said backing material from said needles, means for oscillating the hooks toward and away from the path of the needles in timed relationship with the needle reciprocation for seizing respective loops, and a knife cooperating with each hook for cutting loops of yarn seized and retained thereon, the improvement wherein each hook comprises a body member having a bill and a shank, said bill extending from the shank to define a throat therebetween, a barb extending from said bill remote from said shank, said bill having a top edge and a bottom edge that extends from said throat to said barb, said barb having a top edge that slopes toward the top edge of said bill and a bottom edge spaced below the bottom edge of said bill to define a joining edge connecting the bottom edge of said barb and the bottom edge of said bill, said top edge of said bill being dimensionally reduced relative to said bottom edge for a portion of the extent of the top edge of said bill, said reduced portion extending from adjacent the top edge of the barb to at least substantially intermediate said joining edge and said throat.

6. In a tufting machine as recited in claim 5, wherein each said knife engages and cuts said loops at a point on said bottom edge, and said reduced portion extends from the top edge of the barb to a location disposed substantially above said point.

7. In a tufting machine as recited in claim 6, wherein said means for supporting said moving backing material includes a plurality of spaced fingers, each needle traveling in a path disposed between a pair of said fingers, and means for oscillating said fingers in timed relationship with said hook from a disposition in the path of needle reciprocation for supporting said material during penetration thereof to a disposition withdrawn from said path as said hook moves toward said path.

* * * * *